US007500275B2

(12) United States Patent
Kim

(10) Patent No.: US 7,500,275 B2
(45) Date of Patent: Mar. 10, 2009

(54) POWER SAVING DEVICE USING TOILET SEAT COVER OF BIDET

(75) Inventor: Bong-Kyun Kim, Cheonan-si (KR)

(73) Assignee: Novita Co., Ltd. (KR)

( * ) Notice: Subject to any disclaimer, the term of this patent is extended or adjusted under 35 U.S.C. 154(b) by 310 days.

(21) Appl. No.: 11/589,411

(22) Filed: Oct. 30, 2006

(65) Prior Publication Data

US 2007/0266487 A1 Nov. 22, 2007

(30) Foreign Application Priority Data

May 22, 2006 (KR) ..... 20-2006-0013645 U

(51) Int. Cl.
*A47K 3/022* (2006.01)

(52) U.S. Cl. ..... 4/420.2; 4/420.4

(58) Field of Classification Search ..... 4/420.1–420.5, 4/443, 447–448
See application file for complete search history.

(56) References Cited

U.S. PATENT DOCUMENTS

| | | | | |
|---|---|---|---|---|
| 6,649,884 | B2 * | 11/2003 | Nonomura | 219/494 |
| 6,880,180 | B2 * | 4/2005 | Hayashi et al. | 4/313 |
| 7,179,473 | B2 * | 2/2007 | Meyers | 424/218.1 |
| 2003/0070215 | A1 * | 4/2003 | Chung | 4/420.4 |
| 2005/0246828 | A1 * | 11/2005 | Shirai et al. | 4/420.4 |
| 2006/0207006 | A1 * | 9/2006 | Koga et al. | 4/420.4 |

* cited by examiner

*Primary Examiner*—Charles E Phillips
(74) *Attorney, Agent, or Firm*—Cantor Colburn LLP

(57) ABSTRACT

Provided is a power saving device using a toilet seat cover of a bidet. The device includes: a toilet seat cover sensor for detecting whether the toilet seat cover is opened or closed and outputting an electrical signal corresponding the detected result; and a control means for controlling the toilet seat and the warm water to be at low temperatures on the basis of the detected result of the toilet seat cover sensor when a power saving mode is OFF and the bidet is not used. Therefore, it is possible to remarkably reduce power consumption of the bidet during a standby mode.

3 Claims, 3 Drawing Sheets

POWER SAVING DEVICE USING TOILET SEAT COVER OF BIDET

CROSS-REFERENCE TO RELATED APPLICATION

This application claims the benefit of Korean Utility Model Application No. 20-2006-0013645, filed May 22, 2006, the disclosure of which is hereby incorporated herein by reference in its entirety.

BACKGROUND OF THE INVENTION

1. Field of the Invention

The present invention relates to a power saving device using a toilet seat cover of a bidet and, more particularly, to a power saving device using a toilet seat cover of a bidet capable of remarkably reducing power consumption of the bidet during a standby mode.

2. Description of the Related Art

Generally, a warm-water cleaner (hereinafter, referred to as "bidet") is used to clean the rectal area and genitals.

The bidet performs functions of cleaning the rectal area after a bowel movement using cleaning water ejected through a nozzle, without tissue, automatically cleaning a woman's genitals using the cleaning water, and massaging the genitals by continuously reciprocating the nozzle ejecting the cleaning water.

The conventional bidet includes a water supply means for supplying cleaning water, a storage tank for storing water, a heating means for heating the storage tank to maintain the water in the storage tank at a certain temperature, a control means for adjusting an amount of water discharged from the storage tank, a key part having a plurality of keys for setting a power saving mode, and setting temperatures of warm water and a toilet seat cover during a power saving mode, a cleaning nozzle for ejecting water discharged from the storage tank to a user's rectal area, a bidet nozzle for ejecting water discharged from the storage tank to a user's genitals, a nozzle cleaning part for supplying water discharged from the storage tank to the cleaning nozzle and the bidet nozzle to clean the nozzles, and a seating sensor for detecting whether a user is seated on a toilet seat.

In the conventional bidet, when a user manipulates the key part to set temperatures of the warm water and the toilet seat during the power saving mode, the control means stores the set temperature. When the user manipulates the key part to select the power saving mode in this state, the control means controls the warm water and the toilet seat at predetermined temperatures when the seating sensor detects that the user is not on the toilet seat.

However, when the conventional bidet is not used for a long time in a state in which the power saving mode is not set, the control means is controlled to maintain a high temperature set by the user, regardless of whether the toilet seat cover is opened or closed, thereby increasing power consumption during the standby mode.

SUMMARY OF THE INVENTION

In order to solve the foregoing and/or other problems, it is an aspect of the present invention to provide a power saving device using a toilet seat cover of a bidet capable of remarkably reducing power consumption of the bidet during a standby mode.

Additional aspects and advantages of the present invention will be set forth in part in the description which follows and, in part, will be obvious from the description, or may be learned by practice of the invention.

The foregoing and/or other aspects of the present invention may be achieved by providing a power saving device using a toilet seat cover of a bidet including: a toilet seat cover sensor for detecting whether the toilet seat cover is opened or closed and outputting an electrical signal corresponding the detected result; and a control means for controlling the toilet seat and the warm water to be at low temperatures on the basis of the detected result of the toilet seat cover sensor when a power saving mode is OFF and the bidet is not used.

BRIEF DESCRIPTION OF THE DRAWINGS

These and/or other aspects and advantages of the present invention will become apparent and more readily appreciated from the following description of exemplary embodiments, taken in conjunction with the accompanying drawings of which.

DETAILED DESCRIPTION OF THE INVENTION

Figure 1:
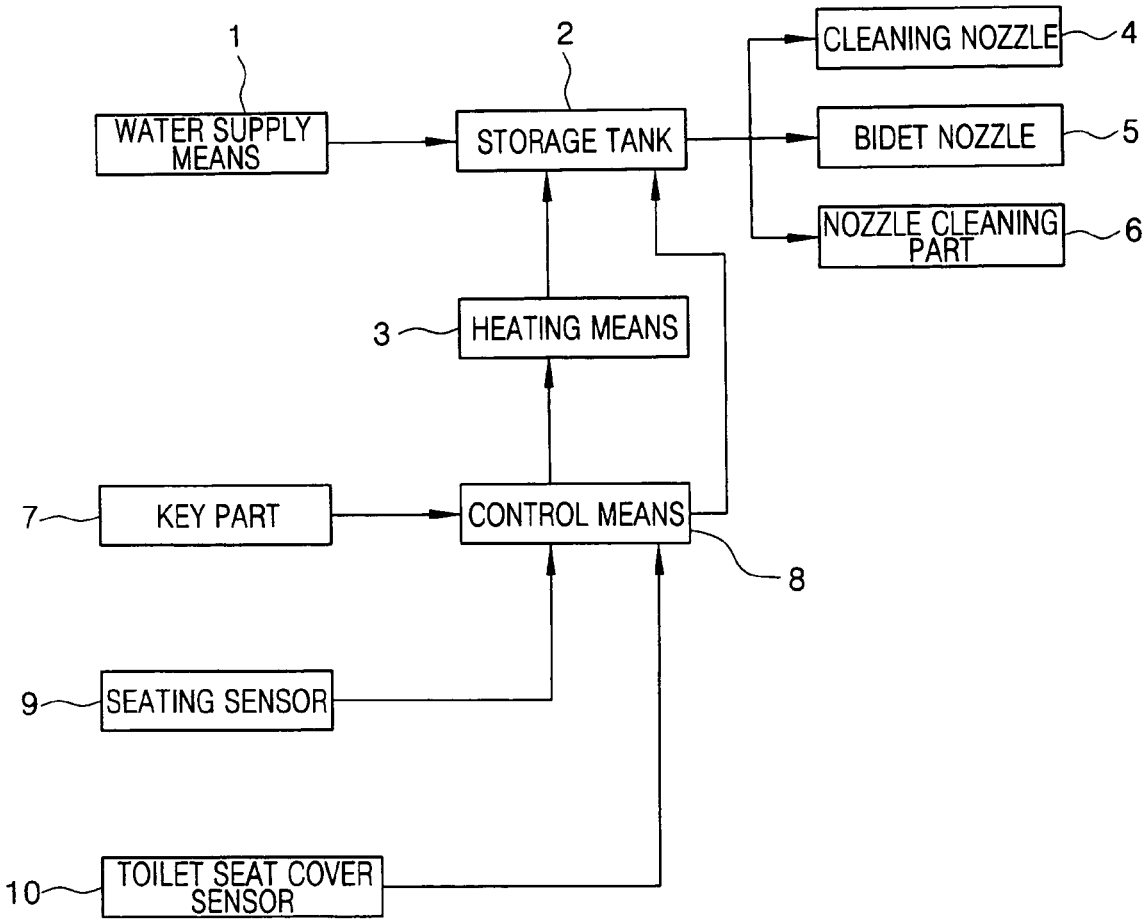
FIG. 1 is a block diagram showing a function of a power saving device using a toilet seat cover of a bidet in accordance with the present invention.
Figure 2:
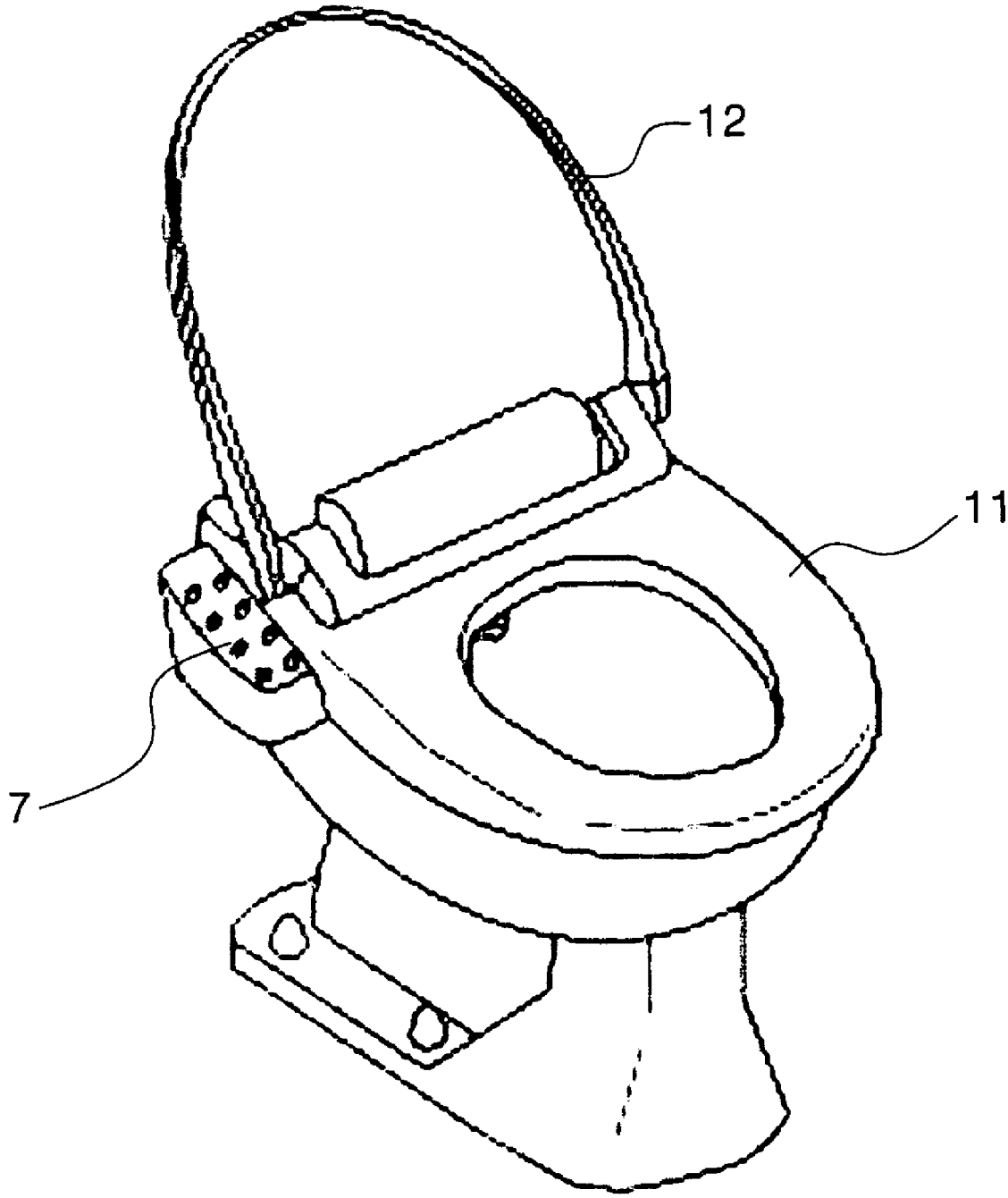
FIG. 2 is a perspective view of an opened toilet seat cover of a bidet in accordance with the present invention.
Figure 3:
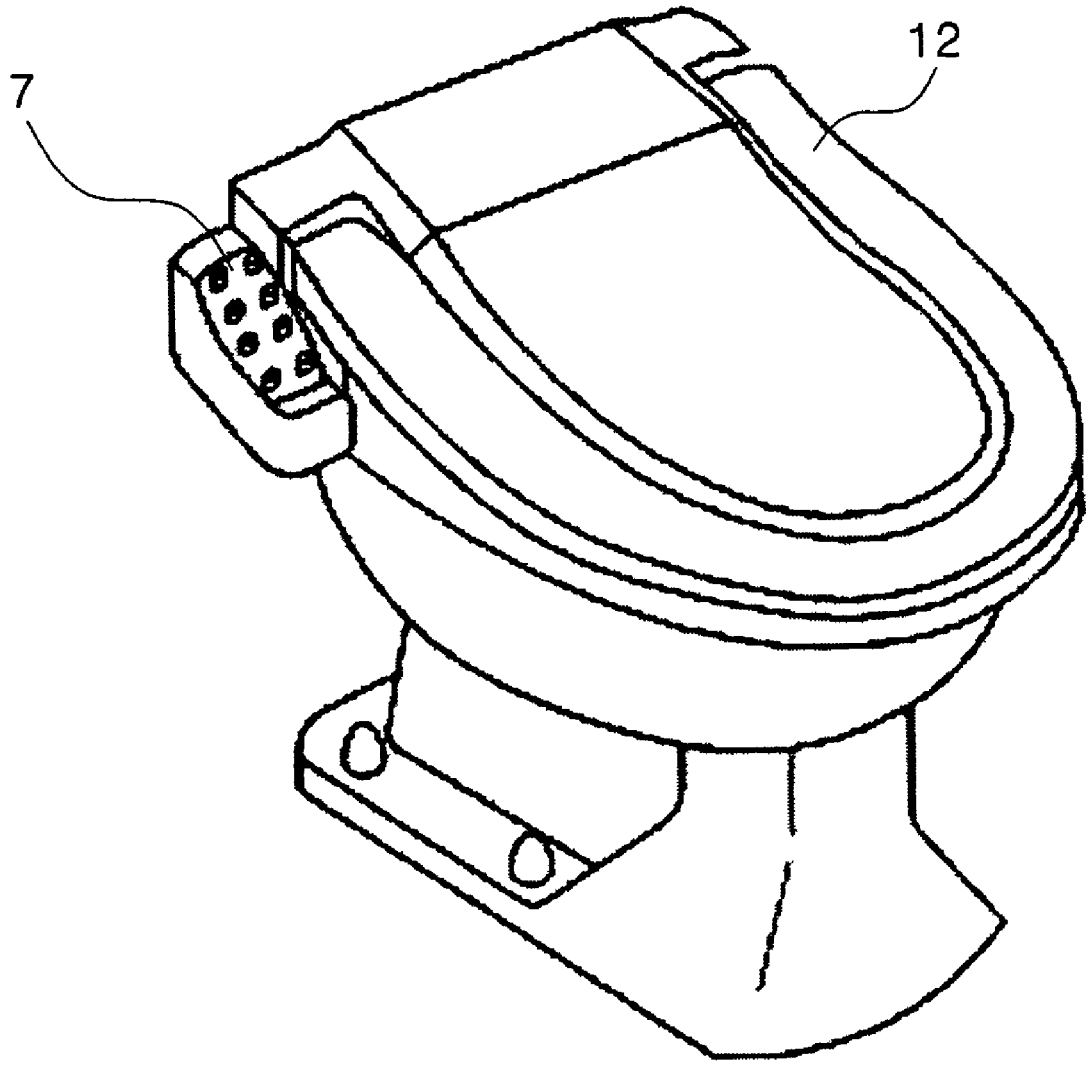
FIG. 3 is a perspective view of a closed toilet seat cover of a bidet in accordance with the present invention.

Reference will now be made in detail to an exemplary embodiment of the present invention, which is illustrated in FIGS. 1 to 3.

Referring to FIGS. 1 to 3, a bidet includes a water supply means 1 for supplying cleaning water, a storage tank 2 for storing water, a heating means 3 for heating the storage tank 2 to maintain the water in the storage tank at a certain temperature, a control means 8 for adjusting an amount of water discharged from the storage tank 2, a key part 7 having a plurality of keys for setting a power saving mode, and setting temperatures of warm water and a toilet seat cover during a power saving mode, a cleaning nozzle 4 for ejecting water discharged from the storage tank 2 to a user's rectal area, a bidet nozzle 5 for ejecting water discharged from the storage tank 2 to a user's genitals, a nozzle cleaning part 6 for supplying water discharged from the storage tank 2 to the cleaning nozzle 4 and the bidet nozzle 5 to clean the nozzles, and a seating sensor 9 for detecting whether a user is seated on a toilet seat.

In addition, the bidet further includes a toilet seat cover sensor 10 for detecting whether the toilet seat cover 12 is opened or closed and outputting an electrical signal corresponding the detected result; and a control means 8 for controlling the toilet seat and the warm water to be at low temperatures on the basis of the detected result of the toilet seat cover sensor 10 when the power saving mode is OFF and the bidet is not used.

As a result of the detection of the toilet seat cover sensor 10, when the toilet seat cover 12 is closed, the control means 8 controls the toilet seat to be at a temperature of 30~34° C. and the warm water to be at a temperature of 33~37° C., thereby reducing power consumption.

Operation of the power saving device in accordance with the present invention will be described below.

First, when the toilet seat cover 12 is opened in a state in which the power saving mode is OFF, the toilet seat cover sensor 10 detects opening of the toilet seat cover 12 to transmit a signal to the control means 8. After detecting opening of the toilet seat cover 12, the control means 8 determines whether the bidet has been used for a certain time on the basis of the information detected by the seating sensor 9.

When it is determined that the bidet has not been used for the certain time, the control means 8 maintains the toilet seat 11 and the warm water at predetermined temperatures.

That is, when the toilet seat cover 12 is opened in a state in which the power saving mode is OFF, the toilet seat and the warm water are maintained at predetermined temperatures to reduce power consumption.

However, when the toilet seat cover 12 is closed as shown in FIG. 3, the toilet seat cover sensor 10 detects the closing of the toilet seat cover 12 to transmit a signal to the control means 8. And, the control means 8 detects the OFF of the power saving mode and the closing of the toilet seat cover 12 in a state in which the bidet is not used for a certain time, and maintains the toilet seat at a low temperature of 30~34° C. and the warm water at a low temperature of 33~37° C., thereby reducing power consumption during the standby mode.

Meanwhile, in a state in which the power saving mode is ON, the control means 8 maintains the toilet seat at a temperature of 28° C. and the warm water at a temperature of 25° C. when the toilet seat cover 12 is opened. When the power saving mode is ON, when the toilet seat cover 12 is closed, the control means 8 performs control not to apply power to the toilet seat and the warm water to cut power consumption.

As can be seen from the foregoing, a power saving device using a toilet seat cover of a bidet includes a toilet seat cover sensor for detecting whether the toilet seat cover is opened or closed and outputting an electrical signal corresponding the detected result; and a control means for controlling the toilet seat and the warm water to be at low temperatures on the basis of the detected result of the toilet seat cover sensor when a power saving mode is OFF and the bidet is not used, thereby remarkably reducing power consumption of the bidet during a standby mode.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A power saving device using a toilet seat cover of a bidet, the bidet comprising: a water supply means for supplying cleaning water; a storage tank for storing water; a heating means for heating the storage tank to maintain the water in the storage tank at a certain temperature; a key part having a plurality of keys for setting a power saving mode, and setting temperatures of a warm water and a toilet seat cover during a power saving mode; a cleaning nozzle for ejecting water discharged from the storage tank to a user's rectal area; a bidet nozzle for ejecting water discharged from the storage tank to a user's genitals; a nozzle cleaning part for supplying water discharged from the storage tank to the cleaning nozzle and the bidet nozzle to clean the nozzles; and a seating sensor for detecting whether a user is seated on a toilet seat, characterized in that the bidet further comprises: a toilet seat cover sensor for detecting whether the toilet seat cover is opened or closed and outputting an electrical signal corresponding the detected result; and a control means for adjusting an amount of water discharged from the storage tank and controlling the toilet seat and the warm water to be at low temperatures on the basis of the detected result of the toilet seat cover sensor when the power saving mode is OFF and the bidet is not used.

2. The power saving device using a toilet seat cover of a bidet according to claim 1, wherein the control means controls the toilet seat to be at a temperature of 30 to 34° C. when the toilet seat cover is detected to be closed by the toilet seat cover sensor.

3. The power saving device using a toilet seat cover of a bidet according to claim 1, wherein the control means controls the warm water to be at a temperature of 33 to 37° C. when the toilet seat cover is detected to be closed by the toilet seat cover sensor.

* * * * *